US008525411B1

(12) United States Patent
Dinsmore et al.

(10) Patent No.: US 8,525,411 B1
(45) Date of Patent: Sep. 3, 2013

(54) ELECTRICALLY HEATED PLANAR CATHODE

(75) Inventors: Mark T. Dinsmore, Sudbury, MA (US); David J. Caruso, Groton, MA (US)

(73) Assignee: Thermo Scientific Portable Analytical Instruments Inc., Tewksbury, MA (US)

( * ) Notice: Subject to any disclaimer, the term of this patent is extended or adjusted under 35 U.S.C. 154(b) by 0 days.

(21) Appl. No.: 13/468,886

(22) Filed: May 10, 2012

(51) Int. Cl.
*H01J 17/04* (2012.01)

(52) U.S. Cl.
USPC ..... 313/632; 313/631; 313/495

(58) Field of Classification Search
USPC ..... 313/491, 495, 496, 628, 629, 631, 313/632
See application file for complete search history.

(56) References Cited

U.S. PATENT DOCUMENTS 7,657,003 B2 2/2010 Adams
2010/0239828 A1 9/2010 Cornaby et al.

*Primary Examiner* — Vip Patel
(74) *Attorney, Agent, or Firm* — Gordon Stewart

(57) ABSTRACT

An electrically heated planar cathode for use in miniature x-ray tubes may be spiral design laser cut from a thin tantalum alloy ribbon foil (with grain stabilizing features). Bare ribbon is mounted to an aluminum nitride substrate in a manner that is puts the ribbon in minimal tension before it is machined into the spiral pattern. The spiral pattern can be optimized for electrical, thermal, and emission characteristics.

15 Claims, 4 Drawing Sheets

ELECTRICALLY HEATED PLANAR CATHODE

BACKGROUND

An X-ray tube is a vacuum tube that produces X-rays. The X-ray tube includes a cathode for emitting electrons into the vacuum and anode to collect the electrons. A high voltage power source is connected across the cathode and anode to accelerate the electrons. Some applications require very high-resolution images and require X-ray tubes that can generate very small focal spot sizes.

One type of cathode includes a tungsten filament that is helically wound in a spiral, similar to a light bulb filament. The problem with the wound filament is that the electrons are emitted from surfaces that are not perpendicular to the accelerating electrical fields. This makes it very difficult to focus the electrons into a compact spot on the x-ray target.

SUMMARY

An electrically heated planar cathode for use in miniature x-ray tubes includes a spiral design laser cut from a thin tantalum alloy ribbon foil (with grain stabilizing features). Bare ribbon is brazed to an aluminum nitride substrate in a manner that puts the ribbon in minimal tension before it is machined into a geometric pattern, e.g. a spiral. This prevents distortion of the planar pattern either by the cutting process or through handling and mounting. The spiral pattern can be optimized for electrical and thermal characteristics. The resulting cathode assembly is mounted to a header for mechanical and electrical connection to the rest of the X-ray tube components.

DETAILED DESCRIPTION

An electrically heated planar cathode for use in miniature x-ray tubes includes a spiral design laser cut from a thin tantalum alloy ribbon foil (with grain stabilizing features). Bare ribbon is brazed to an aluminum nitride substrate in a manner that puts the ribbon in minimal tension before it is machined into a geometric pattern, e.g. a spiral. This prevents distortion of the planar pattern either by the cutting process or through handling and mounting. The spiral pattern can be optimized for electrical and thermal characteristics. The resulting cathode assembly is mounted to a header for mechanical and electrical connection to the rest of the X-ray tube components. The remaining tantalum tape outside the cathode spiral forms an equipotential surface that helps form a very collimated and easily focused electron beam.

Figure 1A:
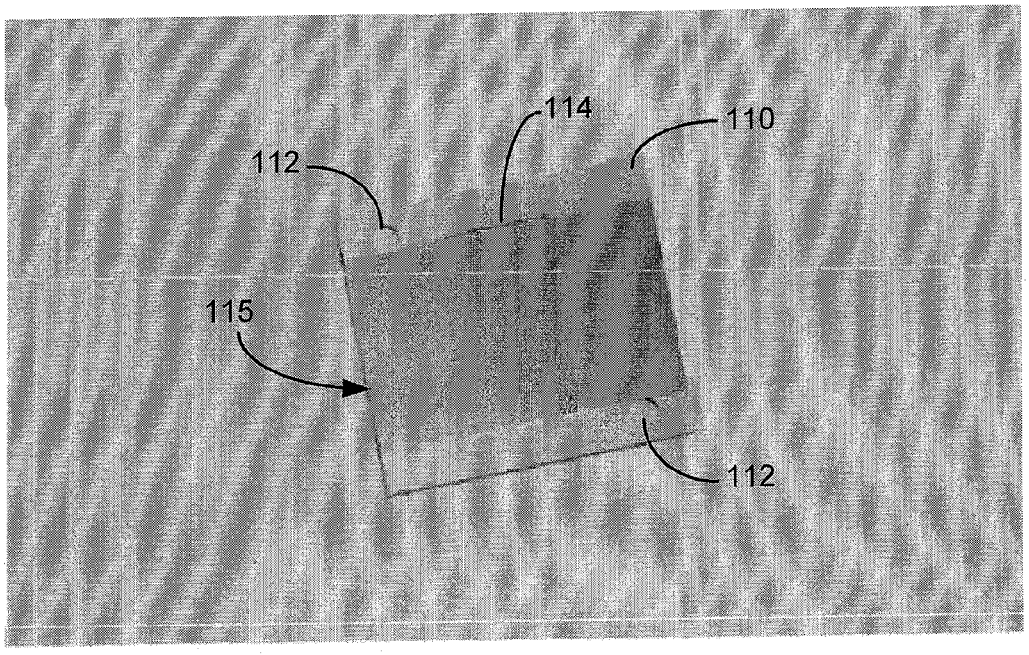
FIG. 1A illustrates a planar cathode structure before cutting.

The particular implementation solves the problem of the fragility of such a structure by mounting the foil to the substrate prior to machining. The use of grain stabilized tantalum is important because of the potential for mechanical distortion due to grain growth that is induced when the cathode is run at operating temperature. This distortion moves the spiral away from the plane of the tantalum ribbon FIG. 1A illustrates a planar cathode structure before cutting. A substrate 110 includes optional alignment features 112 and a hole 114. A tantalum ribbon brazed to an AlN substrate 116 is mounted over the hole 114. There is a slight overlap of the ribbon, e.g. tantalum, with the substrate to allow the substrate to absorb any stray emission currents when in operation. The hole 114 is illustratively shown to be larger than needed.

Figure 1B:
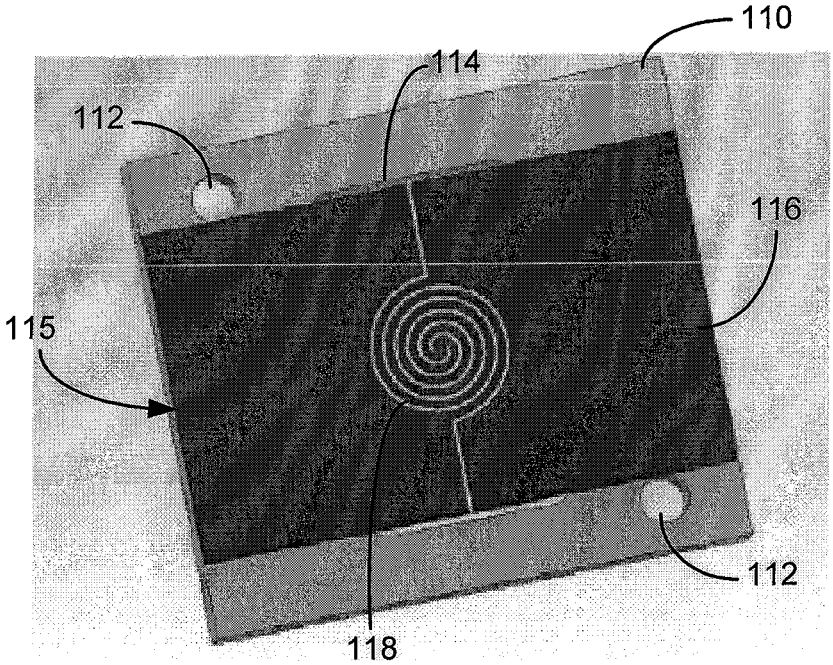
FIG. 1B illustrates a planar cathode structure post laser cutting.

FIG. 1B illustrates a planar cathode structure post laser cutting. A spiral cut 118 has been introduced. The entry and exit of the spiral cut is rounded to minimize sharp corners, thus reducing stray emission currents. In the embodiment, the entry and exit of the spiral cut have been exaggerated to better illustrate minimizing sharp corners.

In this illustrative embodiment, the substrate 110 is made of aluminum nitride (AlN).

While this embodiment illustrates the geometric pattern of the laminate 115 suspended over the opening 114 in the substrate 110, an opening is optional. There needs to be thermal isolation between the geometric pattern and the substrate 110. To illustrate, thermal isolation may be achieved by an opening, a cavity, or by suspending the laminate 115 over the substrate 110 such that there is an air gap.

Figure 1C:
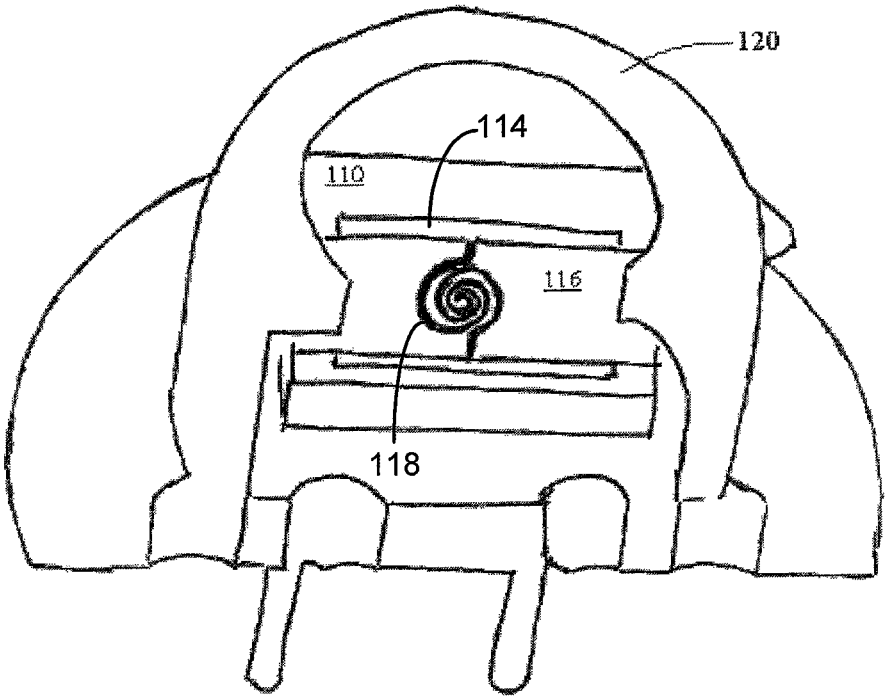
FIG. 1C illustrates a packaged planar cathode structure.

FIG. 1C illustrates the planar cathode mounted in a typical header and lens assembly 120.

Figure 2:
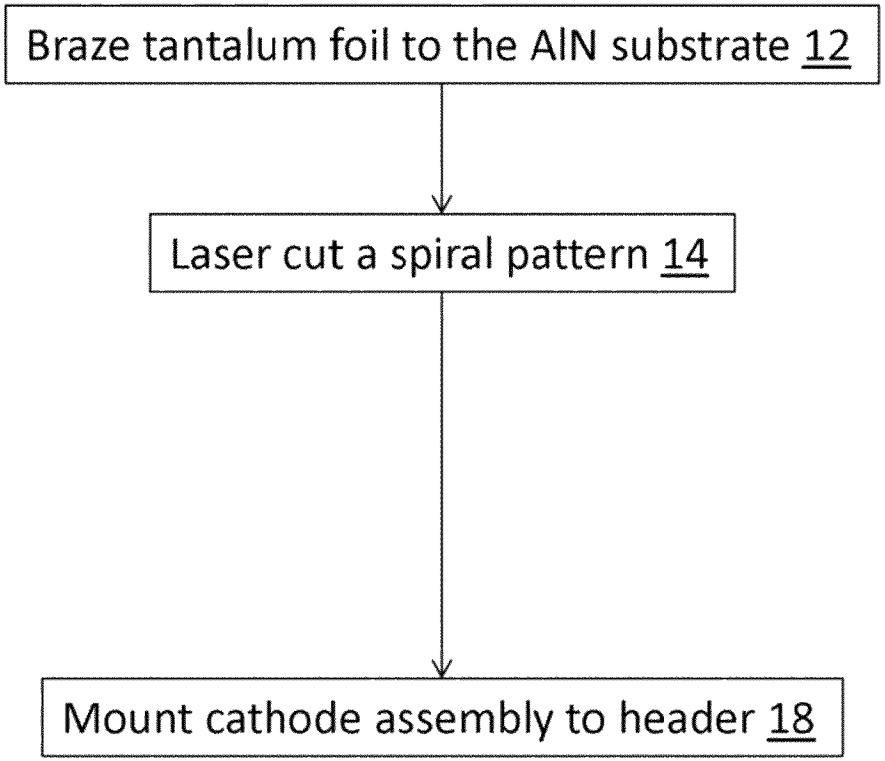
FIG. 2 is a process flow chart for the planar cathode shown in FIG. 1A and FIG. 1B.

FIG. 2 is a process flow chart for the planar cathode shown in FIG. 1A and FIG. 1B. In step 12, tantalum foil is brazed to an AlN substrate. The brazing may be accomplished by a foil using an active braze material to an AlN substrate to generate a laminate or metalizing the substrate and using conventional brazing processes to generate the laminate. In step 14, a spiral pattern is laser cut or etched. The subsequent cathode may be handled without damaging the spiral pattern due to the substrate. Optional alignment features are added during the manufacture of the substrate, as machining them after brazing or cutting would endanger the spiral. In the process, the alignment features are used to calibrate position before cutting the spiral, so that the spiral is centered between the alignment features. In step 18, the cathode assembly is mounted to the header via the alignment features to provide the electrical connections and to mechanically align the cathode with the rest of the electron optical components.

In the illustrative example, the tantalum ribbon was brazed to AlN substrate because they had similar thermal coefficients of expansion. When the cathode is cut out, it remains planar.

The concept may be extended to other materials that do not evaporate or distort over time. Foil materials include, but are not limited to, tungsten rhenium, thoriated tungsten, tungsten alloys, hafnium, and other tantalum based materials, exhibiting an electron work function less than 6 eV. Coatings can be added to the spiral to reduce the work function of the spiral, thus permitting use of different spiral materials and reducing the temperature and power needed to produce adequate electron flux.

We claim:

1. A planar cathode, comprising:

a first substrate; and a laminate of a foil and a second substrate, the foil and the second substrate having matching thermal coefficients of expansion, the laminate being suspended over the first substrate, wherein the foil is shaped into a predetermined geometric pattern, the foil having performance parameters that are selected from a group including area, voltage, current, power, and electron emission; and wherein there is thermal isolation between the foil and the first substrate.

2. A planar cathode, as in claim 1, the first substrate further including alignment features, wherein the alignment features are selected from a group including holes, mechanical features, and optical features.

3. A planar cathode, as in claim 1, wherein the laminate of the foil and the second substrate is tantalum foil brazed to an AlN substrate.

4. A planar cathode, as in claim 1, wherein the predetermined geometric pattern is a spiral cut on the foil.

5. A planar cathode, as in claim 4, the spiral cut including a rounded entry and a rounded exit.

6. A planar cathode, as in claim 1, wherein the foil is selected from a group including tungsten rhenium, thoriated tungsten, tungsten alloys, hafnium, and tantalum based materials having a work function less than 6 eV.

7. A planar cathode, as in claim 1, wherein the foil is coated to exhibit an electron work function less than 6 eV.

8. A method of making a planar cathode, comprising:

brazing a foil to an AlN substrate to generate a laminate;

shaping the foil in the laminate into a predetermined geometric pattern; and mounting the laminate on a header.

9. A method, as in claim 8, wherein the predetermined geometric pattern is a spiral.

10. A method, as in claim 9, wherein the spiral includes a rounded entry and a rounded exit.

11. A method, as in claim 8, wherein the foil is selected from a group including tungsten rhenium, thoriated tungsten, tungsten alloys, and other refractory based thermionic emission materials, or cathodes made with a low work function emission coating.

12. A method, as in claim 8, wherein the foil is selected from a group including tungsten rhenium, thoriated tungsten, tungsten alloys, hafnium, and tantalum based materials having a work function less than 6 eV.

13. A method, as in claim 8, including coating the foil to exhibit an electron work function less than 6 eV.

14. A method, as in claim 8, wherein the shaping of the foil in the laminate includes laser cutting the foil to form the predetermined geometric pattern in the laminate.

15. A method, as in claim 8, wherein the shaping of the foil in the laminate includes etching the foil to form the predetermined geometric pattern in the laminate.

* * * * *